US008761652B2

(12) United States Patent
Rimai et al.

(10) Patent No.: US 8,761,652 B2
(45) **Date of Patent: *Jun. 24, 2014**

(54) PRINTER WITH LIQUID ENHANCED FIXING SYSTEM

(75) Inventors: Donald Saul Rimai, Webster, NY (US); Thomas Nathaniel Tombs, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 208 days.

This patent is subject to a terminal disclaimer.

(21) Appl. No.: 13/334,707

(22) Filed: Dec. 22, 2011

(65) Prior Publication Data

US 2013/0164062 A1 Jun. 27, 2013

(51) Int. Cl.
*G03G 15/20* (2006.01)

(52) U.S. Cl.
USPC ..... 399/336

(58) Field of Classification Search
USPC ..... 399/336; 347/103
See application file for complete search history.

(56) References Cited

U.S. PATENT DOCUMENTS

| | | | | |
|---|---|---|---|---|
| 4,068,241 | A | 1/1978 | Yamada | |
| 4,312,268 | A * | 1/1982 | King et al. | 346/25 |
| 4,636,808 | A | 1/1987 | Herron | |
| 4,943,816 | A * | 7/1990 | Sporer | 346/25 |
| 5,847,721 | A | 12/1998 | Ogata et al. | |
| 6,079,821 | A | 6/2000 | Chwalek et al. | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,608,641 | B1 | 8/2003 | Alexandrovich et al. | |
| 6,702,425 | B1 | 3/2004 | Yip et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,232,214 | B2 | 6/2007 | Yip et al. | |
| 2004/0005155 | A1 * | 1/2004 | Miyazaki | 399/2 |
| 2006/0133870 | A1 | 6/2006 | Ng et al. | |
| 2013/0162741 | A1 * | 6/2013 | Tombs et al. | 347/103 |
| 2013/0164061 | A1 * | 6/2013 | Tombs et al. | 399/336 |

FOREIGN PATENT DOCUMENTS

| | | | |
|---|---|---|---|
| JP | 63261289 A | * | 10/1988 |
| JP | 2010026386 A | * | 2/2010 |

* cited by examiner

*Primary Examiner* — David Gray
*Assistant Examiner* — Tyler Hardman
(74) *Attorney, Agent, or Firm* — Roland R. Schindler, II

(57) ABSTRACT

Printers are provided. One printer has an ink jet printer with an inkjet printhead to print an inkjet image on a receiver using an inkjet ink having a liquid with a boiling point a toner print engine to generate a toner image conforming to the ink jet image using toner particles with a glass transition temperature that is below the boiling point and to transfer the toner image into an unabsorbed volume of liquid ink of the inkjet image on the receiver and a fixing system having a first energy source to apply a first energy to the toner and the liquid sufficient to bring the liquid to the boiling point without bringing a heated surface into contact therewith. The toner particles are heated above the glass transition temperature by the combination of heat from the liquid and heating of the toner particles by the first energy.

12 Claims, 14 Drawing Sheets

139
77
42

NON-
CONTACT
FIXING
139
77
42

ROLLER
FUSING
93
32

GLOSSING
95
32

PRINTER WITH LIQUID ENHANCED FIXING SYSTEM

CROSS-REFERENCE TO RELATED APPLICATIONS

This application relates to commonly assigned, copending U.S. application Ser. No. 13/334,574, filed Dec. 22, 2011, entitled: "INKJET PRINTING METHOD WITH ENHANCED DEINKABILITY"; U.S. application Ser. No. 13/334,661, filed Dec. 22, 2011, entitled: "INKJET PRINTER WITH ENHANCED DEINKABILITY"; U.S. application Ser. No. 13/334,683, filed Dec. 22, 2011, entitled: "LIQUID ENHANCED FIXING METHOD"; U.S. application Ser. No. 13/334,453, filed Dec. 22, 2011, entitled: "INKJET PRINTING ON SEMI-POROUS OR NON-ABSORBENT SURFACES"; U.S. application Ser. No. 13/334,473, filed Dec. 22, 2011, entitled: "INKJET PRINTER FOR SEMI-POROUS OR NON-ABSORBENT SURFACES"; U.S. application Ser. No. 13/334,487, filed Dec. 22, 2011, entitled: "METHOD FOR PRINTING ON LOCALLY DISTORTABLE MEDIUMS"; U.S. application Ser. No. 13/334, 495, filed Dec. 22, 2011, entitled: "PRINTER FOR USE WITH LOCALLY DISTORTABLE MEDIUMS"; U.S. application Ser. No. 13/334,509, filed Dec. 22, 2011, entitled: "METHOD FOR PRINTING WITH ADAPTIVE DISTORTION CONTROL", and U.S. application Ser. No. 13,334, 524, filed Dec. 22, 2011, entitled: "PRINTER WITH ADAPTIVE DISOTRTION CONTROL", each of which is hereby incorporated by reference.

FIELD OF THE INVENTION

This invention pertains to the field of printing.

BACKGROUND OF THE INVENTION

Electrostatic and electrophotographic printing involves developing a latent electrostatic image with charged toner particles loaded onto an imaging drum and transferring them onto a substrate or a print substrate, particularly in the form of sheets or in the form of a continuous conveyor belt. As an example, in four-color printing, four latent images in the four-color separations (cyan, magenta, yellow, and black) are transferred to the substrate successively and in register on top of one other. In particular, the finished single color or multicolored latent image is then fused onto the substrate by a fusing device. This customarily takes place by a heatable fusing roller, which is rolled onto the toner image. The toner is heated up above its glass transition temperature, and thus melted, and simultaneously incorporated under pressurization into the substrate to which it is fused after it has been cooled. Adjacent toner particles are thereby combined, which finally form a polymer layer on the substrate.

Alternatively, fixing can be performed in other ways, for example, by exposing the toner and the substrate to which the toner is to be fused to microwaves. Such microwaves heat water in the printing substrate to which the toner is to fuse. This water heats the substrate. The substrate then transfers heat into the toner to cause the toner to reach the glass transition temperature. However, it has been difficult in the past for such microwave fusing systems to operate in the optimal fusing area (fusing window) between a fusing extent that provides an inconsistent gloss and blister formation of the toner on the substrate. This window is very narrow, in particular with the use of glossy-coated paper as the substrate.

To address such problems, U.S. Pat. No. 6,909,871 entitled Method and Device for Fusing Toner Onto a Substrate, filed by Behnke et al. on Apr. 14, 2003, proposes combining these methods and describes a fusing method wherein a heated fusing roller is used to heat the toner, under pressure, to a temperature that is greater or equal to a glass transition temperature, and additionally applying microwaves heat the toner on a substrate. In order to achieve a better energy input, Behnke et al. proposes that the substrate can be moistened before microwaves are applied to the substrate and suggests applying 100 degree C. hot steam to the substrate. Behnke et al. also suggests that the substrate could preferably be moistened on both sides, in order to avoid stressing and bending of the substrate and notes that one advantage of this technique is that the substrate carrying the toner can be warmed by the heat from the steam.

However, while the system that is described in Behnke et al. is useful for many purposes, there are many complications associated with the use of contact fusing such as is done with heated rollers or belts and in many applications fusing without using a contact surface such as a roller or belt is preferred.

Thus, what is still needed in the art are methods and printers that enable effective non-contact fixing of toner.

SUMMARY OF THE INVENTION

Printers are provided. One printer has an ink jet printer with an inkjet printhead to print an inkjet image on a receiver using an inkjet ink having a liquid with a boiling point a toner print engine to generate a toner image conforming to the ink jet image using toner particles with a glass transition temperature that is below the boiling point and to transfer the toner image into an unabsorbed volume of liquid ink of the inkjet image on the receiver and a fixing system having a first energy source to apply a first energy to the toner and the liquid sufficient to bring the liquid to the boiling point without bringing a heated surface into contact therewith. The toner particles are heated above the glass transition temperature by the combination of heat from the liquid and heating of the toner particles by the first energy so the toner particles are heated above the glass transition temperature without requiring heating of the receiver to the glass transition temperature of the toner.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

The attached drawings are for purposes of illustration and are not necessarily to scale.

DETAILED DESCRIPTION OF THE INVENTION

Figure 1:
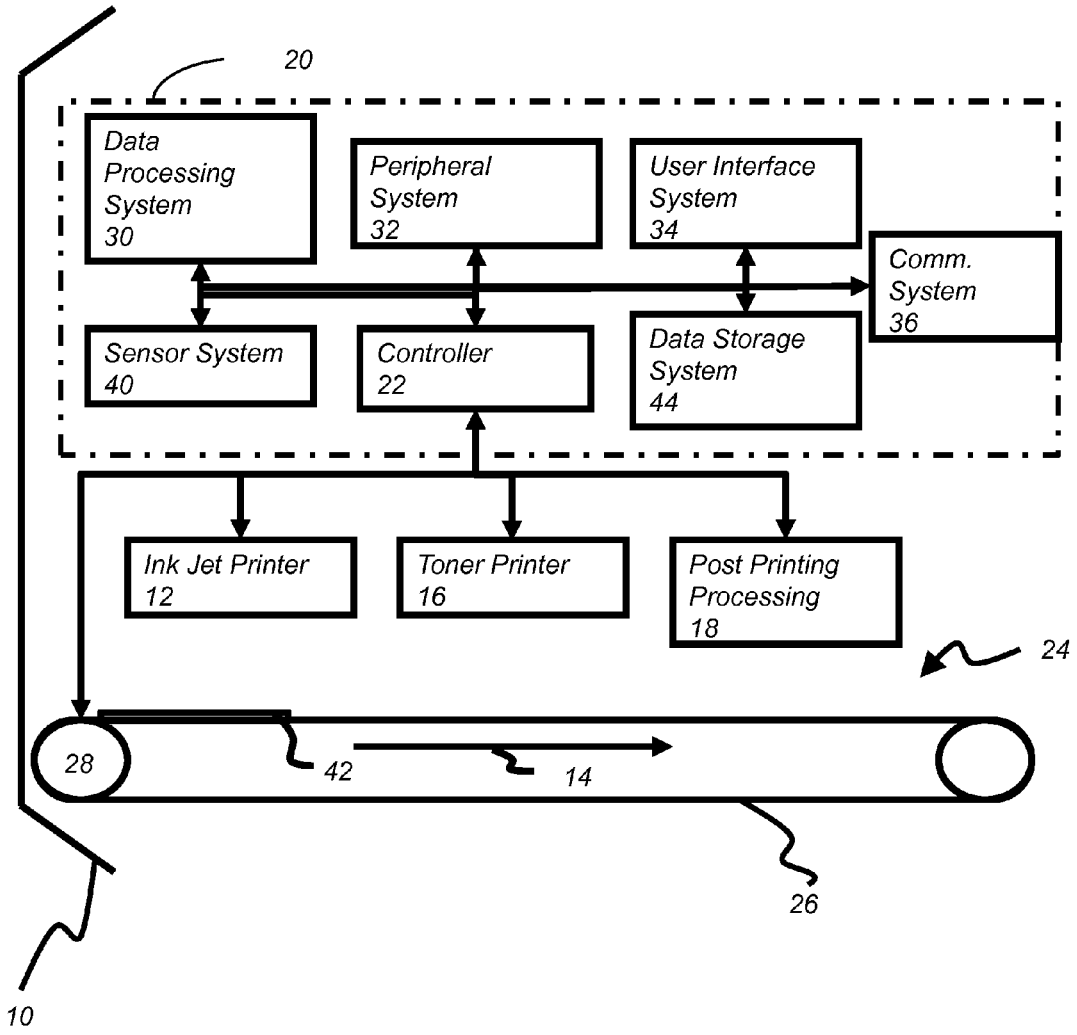
FIG. 1 is a system level view of one embodiment of a printing system.

FIG. 1 shows a system level view of one embodiment of a printing system 10 having an inkjet printer 12, and a toner printer 16. As is also shown in FIG. 1, printing system 10 has a control system 20 that controls and integrates operation of inkjet printer 12 and toner printer 16 and a transport system 24 shown here as an endless transport belt 26 that connects ink jet printer 12 and toner printer 16.

In operation, control system 20 causes an actuator 28 such as a motor (not shown) in transport system 24 to move endless transport belt 26 so as to advance a surface shown here as a receiver 42 in a printing direction 14 past ink jet printer 12 and toner printer 16. Receiver 42 can be any type of surface on which an inkjet ink and toner image can be processed using the methods that are described herein, and can comprise, without limitation coated papers such as a clay coated paper, uncoated papers, fabrics, films, glass, ceramics metals or other articles, a non-absorbent paper, a vinyl. In the embodiments that follow receiver 42 is shown in a sheet form, however, continuous web types of receiver 42 can be used.

Although shown as a single endless transport belt 26 in FIG. 1, it will be appreciated that in other embodiments transport system 704 can comprise any type of system that can move a receiver 42 from ink jet printer 12 to toner printer 16 in a manner that allows ink jet printer 12 to form an inkjet image and that allows toner printer 16 to transfer a receiver 42 into an unabsorbed portion of the ink jet ink forming the ink jet image on receiver 42. As is also shown in FIG. 1, transport system 24 also provides a mechanism for moving receiver 42 past an optional post printing processing system 18. Optional post processing system can include but is not limited to cutting, folding, binding, glossing, drying, and fusing systems.

Control system 20 has a controller 22 that is communicatively connected with a data processing system 30, a peripheral system 32, a user interface system 34, and a communication system 36, a sensor system 40 and a data storage system 44.

Controller 22 can comprise any form of control circuit or system that can perform any of the functions or cause any other component of printing system 10 to perform of the functions described herein. In this regard, controller 22 can include a microprocessor incorporating suitable look-up tables and control software executable by controller 22. Controller 22 can also comprise a field-programmable gate array (FPGA), programmable logic device (PLD), microcontroller, or any other control system or systems capable of performing the functions described or claimed herein.

Data processing system 30 includes one or more data processing devices that implement the processes of various embodiments, including the example processes described herein. The phrases "data processing device" or "data processor" are intended to include any data processing device, such as a central processing unit ("CPU"), a desktop computer, a laptop computer, a mainframe computer, a personal digital assistant, a BlackBerry®, a digital camera, cellular phone, or any other device for processing data, managing data, or handling data, whether implemented with electrical, magnetic, optical, biological components, or otherwise.

In one embodiment data processing system 30 can include a digital front-end processor (DFE). The DFE uses image data and production information to form image data for printing such as rasterized bitmaps or other image types and printing instructions that can be used by inkjet printer 12 or toner printer 16 to determine, respectively, how much ink and toner to deposit at specific locations on a receiver 42 and to determine any required post-processing operations to be performed after inkjet and toner printing. Data processing system 30 can also include a color management system that uses known characteristics of the image printing process implemented in printing system 10 to provide known, consistent color reproduction characteristics for various types of input (e.g. digital camera images, film images, computer generated images).

Peripheral system 32 can include one or more devices configured to provide print order data or components thereof such as image data to controller 22 and to data processing system 30. For example, peripheral system 32 can include digital still cameras, digital video cameras, cellular phones, or other data processors, digital front ends, graphic image servers or computing devices or any other devices that can provide image data and printing instructions to control system 20. Data processing system 30, upon receipt of print order data from a device in peripheral system 32, can store such print order data in data storage system 44.

User interface system 34 can include a mouse, a keyboard, another computer, or any device or combination of devices that can determine when a user has made a user input action and that can convert this user input action into data or other signals that can be used by controller 22, data processing system 30 or any other component of control system 20 in operating printer 10. In this regard, although peripheral system 32 is shown separately from user interface system 34, peripheral system 32 can be included as part of user interface system 34.

User interface system 34 also can also include a display device, a processor-accessible memory, or any device or combination of devices allowing control system 20 to provide output signals to a user of printing system 10. In this regard, if user interface system 34 includes a processor-accessible memory, such memory can be part of data storage system 44 even though user interface system 34 and data storage system 44 are shown separately in FIG. 7.

Data storage system 44 includes one or more processor-accessible memories configured to store information, including the information needed to execute the processes of the various embodiments, including the example processes described herein.

Data storage system 44 can be a distributed processor-accessible memory system including multiple processor-accessible memories communicatively connected to data processing system 30 via a plurality of computers or devices. On the other hand, data storage system 44 need not be a distributed processor-accessible memory system and, consequently, can include one or more processor-accessible memories located within a single data processor or device. The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, solid state or semi-conductor Read Only Memory (ROM), and solid state or semi-conductor Random Access Memory.

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors at all. In this regard, although data storage system 44 is shown separately from data processing system 30, one skilled in the art will appreciate that data storage system 44 can be partially or completely incorporated with data processing system 30. Further, although peripheral system 32 and user interface system 34 are shown separately from data processing system 30, one skilled in the art will appreciate that one or both of such systems can be partially or completely within data processing system 30.

Control system 20 uses print order data and production information to determine what image is to be printed by inkjet printer 12 and by toner printer 16 and on what receiver 42 the image is to be printed. Further, data processing system 30 is used to help convert image information into image information. In particular, data processing system 30 can include a dedicated image processor or raster image processor (RIP; not shown), which can include a color separation screen generator or generators or a general purpose processor that is adapted to perform raster image processing and other processing described herein.

Control system 20 is illustrated as being apart from ink jet printer 12 and toner printer 16. However, this is for the purpose of illustration only and it will be understood that in general, any components of control system 20 or any functions that are described as being performed by control system 20 can be located in or performed by components that are located in whole or in part in ink jet printer 12 or toner printer 16 or in other process and control devices normally used therewith such as a digital front end or a print server.

For example, in one embodiment, toner printer 16 comprises a modular attachment for ink jet printer 12 and control system 20 can be found largely within a control system located in ink jet printer 12. In such an embodiment, system costs can be reduced by using of control system electronics that are already available in the ink jet printer 12. In an alternate embodiment, toner printer 16 can be capable of performing control and printing functions for ink jet printer 12 so that ink jet printing functionality can be integrated into extant toner printing systems. In one embodiment of this type, such ink jet printing functionality can be inserted into a tandem print module location in a toner printer 16 so as to allow at least one ink jet printing operation to be performed in close proximity to a toner printing operation.

In still other embodiments, overall system costs and complexities can be reduced through the use of an overall control system 20 that performs control functions for both ink jet printer 12 and toner printer 16. In a further embodiment, both ink jet printer 12 and toner printer 16 can be stand alone devices that can directly cooperate to print as described herein such that the functions of control system 20 are shared between control systems and circuits in the individual devices. It will be understood that further variations are possible and that as used herein control system 20 includes any automatic processing circuit, system or structure that can be used to cause an ink jet printer 12 or a toner printer 16 to perform the functions that are claimed.

Figure 2:
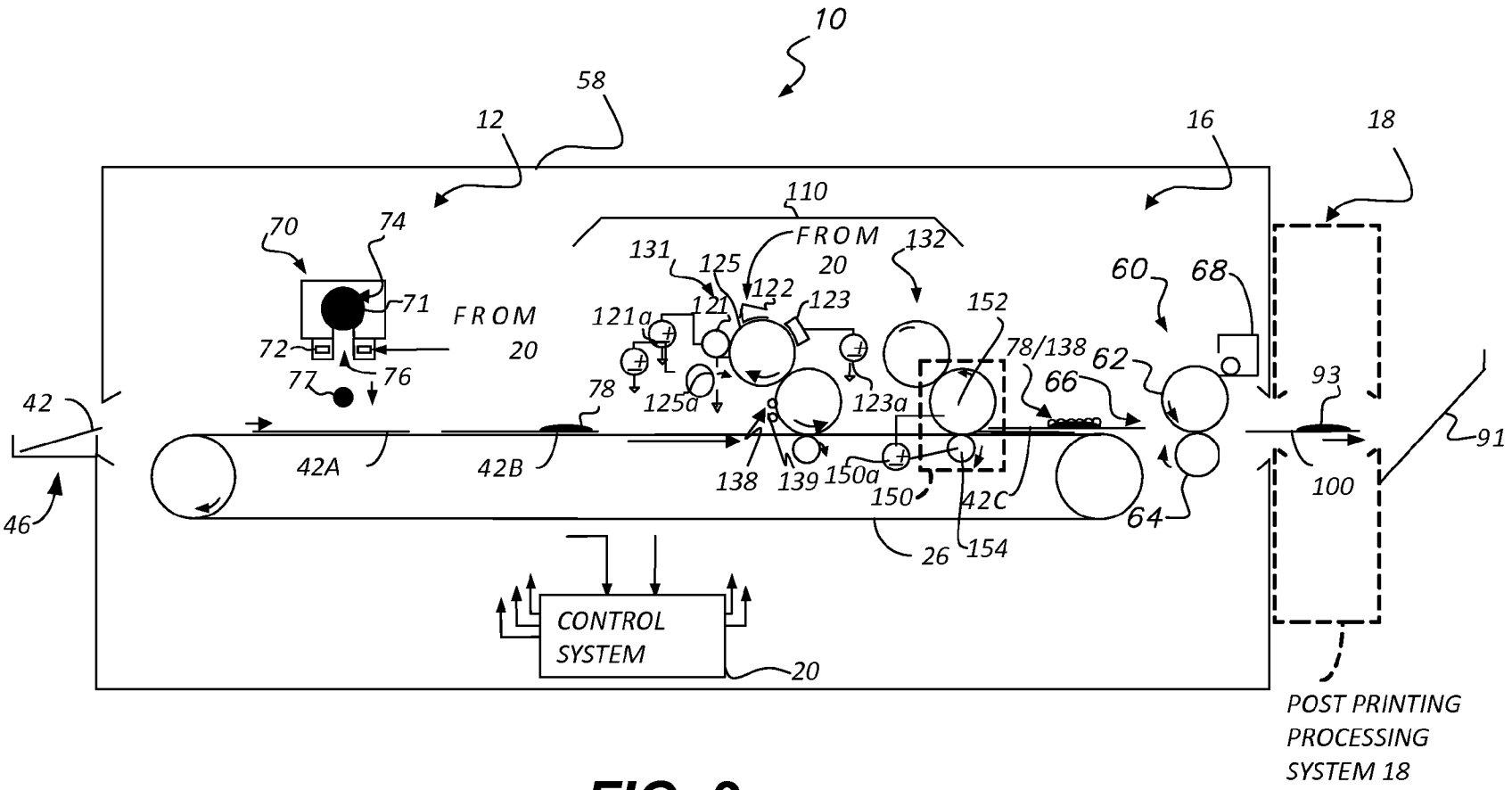
FIG. 2 shows a side schematic view of one embodiment of a printing system.

FIG. 2 shows a side schematic view of one embodiment of a printing system 10. As is shown in this embodiment, ink jet printer 12 and toner printer 16 are integrated into a single housing 58 and share a common transport system 24 shown here as endless transport belt 26. Transport belt 26 carries a receiver 42 from a supply 46 past ink jet printer 12 and toner printer 16.

Inkjet printer 12 forms images on a receiver 42A using an inkjet print engine 70. Inkjet print engine 70 can include a drop-on-demand printhead, either thermal or piezoelectric, or a continuous printhead, using gas, electrostatic, or other deflection methods. The example shown in FIG. 2 is a thermal drop-on-demand inkjet print engine 70. As is shown in FIG. 2, inkjet print engine 70 includes ink manifold 71 that contains liquid inkjet ink 74, either under pressure or not. Heater 72 is a resistive ring heater around nozzle 76 that heats inkjet ink 74 in ink manifold 71 to its boiling point. The expansion in volume as the liquid boils into gas drives ink drop 77 out of nozzle 76 towards a receiver 42. A previously jetted ink drop is shown; it has spread out on receiver 42 to form ink an image 78, as discussed below. Further details of inkjet marking engines are found in U.S. patent application Ser. No. 13,245,931, filed Aug. 27, 2011, U.S. Pat. Nos. 6,588,888, 4,636,808, and 6,851,796, all of which are incorporated herein by reference.

In other embodiments, inkjet print engine 70 can use piezoelectric drop-on-demand systems where current is provided to a piezoelectric actuator to cause the actuator to deflect and push an ink drop out of ink manifold 71. In still other embodiments continuous-inkjet systems pressurize the ink in ink manifold 71 to cause a filament of ink to flow from the nozzle and break the filament into drops in a controlled manner, e.g., by selectively heating the ink stream in an appropriate timing sequence. The drops are then selectively directed along a printing path to a guttering system or to form dots on a receiver 42. In gas-deflection systems, two sizes of drops are produced, and an air flow not parallel with the direction of drop travel separates the two sizes of drops. Drops of one size strike the receiver; drops of the other size are caught and reused. Electrostatic-deflection systems charge drops to one of two charge states, and Lorentz forces between the drops and an electrode separate the two sizes of drops.

After ink jet printer 12 records an inkjet image 78 on receiver 42, receiver 42 is advanced to toner printer 16. Toner printer 16 has a toner print engine 110 that arranges charged toner particles 139 into a toner image 138 and transfers the toner image 138 onto receiver 42B having an inkjet image 78 thereon.

In the embodiment illustrated in FIG. 2, toner print engine 110 is illustrated having a first toner printing module 131 and a second toner printing module 132. First toner printing module 131 and second toner printing module 132 are each capable of independently generating a toner image and transferring toner image 138 to receiver 42B using respective transfer subsystem 150 (for clarity, only one is labeled). In various embodiments, the toner image can be transferred directly from an imaging roller to a receiver 42B, or from an imaging roller to one or more transfer roller(s) or belt(s) in sequence in transfer subsystem 150, and thence to receiver 42B. Receiver 42A, 42B, 42C is, for example, a selected section of a web of, or a cut sheet of, planar media such as paper or transparency film.

In this embodiment, first toner printing module 131 and second toner printing module 132 includes various components. For clarity, these are only shown in first toner printing module 131. As is shown first toner printing module 131 has a photoreceptor 125 and around photoreceptor 125 are arranged, ordered by the direction of rotation of photoreceptor 125, charger 121, exposure subsystem 122, and toning station 123.

An electrostatic latent image is formed on photoreceptor 125 by uniformly charging photoreceptor 125 and then discharging selected areas of the uniform charge to yield an electrostatic charge pattern corresponding to the desired image (a "latent image"). Charger 121 produces a uniform electrostatic charge on photoreceptor 125 or its surface.

Exposure subsystem 122 selectively image-wise discharges photoreceptor 125 to produce a latent image. Exposure subsystem 122 can include a laser and raster optical scanner (ROS), one or more LEDs, or a linear LED array.

After the latent image is formed, charged toner particles are brought into the vicinity of photoreceptor 125 by toning station 123 and are attracted to the latent image to develop the latent image into a toner image. Note that the toner image may not be visible to the naked eye depending on the composition of the toner particles (e.g. clear toner). Toning station 123 can also be referred to as a development station. Toner particles 139 can be applied to either the charged or discharged parts of the latent image on photoreceptor 125.

After the latent image is developed into a visible image on photoreceptor 125, receiver 42B is brought into juxtaposition with the visible image. In transfer subsystem 150, a power supply 150*a* provides a suitable electrostatic field between transfer roller 152 and a pressure roller 154. This field is applied to transfer the toner particles of toner image 138 to receiver 42B to form the desired toner image 138, which includes unfused toner particles, on the receiver, as shown on receiver 42C. The imaging process is typically repeated many times with reusable photoreceptors 125.

Various parameters of the components of a toner printing module such as first toner printing module 131 or second toner printing module 132 can be adjusted to control the operation of printer 16. In an embodiment, charger 121 is a corona charger including a grid between the corona wires (not shown) and photoreceptor 125. Voltage source 121*a* applies a voltage to the grid to control charging of photoreceptor 125. In an embodiment, a voltage bias is applied to toning station 23 by voltage source 123*a* to control the electric field, and thus the rate of toner transfer, from toning station 123 to photoreceptor 125. In an embodiment, a voltage is applied to a conductive base layer of photoreceptor 125 by voltage source 25*a* before development, that is, before toner is applied to photoreceptor 125 by toning station 123. The applied voltage can be zero; the base layer can be grounded. This also provides control over the rate of toner deposition during development. In an embodiment, the exposure applied by exposure subsystem 122 to photoreceptor 125 is control system 20 to produce a colorant attracting toner image 138 corresponding to the desired print image. All of these parameters can be changed.

Further details regarding toner print engines 131, 132 and related components are provided in U.S. Pat. No. 6,608,641, issued on Aug. 19, 2003, to Peter S. Alexandrovich et al., in U.S. Publication No. 2006/0133870, published on Jun. 22, 2006, by Yee S. Ng et al., and U.S. patent application Ser. No. 12/942,420, filed Nov. 9, 2010, by Thomas N. Tombs et al., all of which are incorporated herein by reference.

It will be appreciated that while in the embodiment of FIG. 2, toner printer 16 is illustrated as using electrophotographic systems in first toner printing module 131 and in second toner printing module 132, toner printer 16 is not limited by this and toner printer 16 can be any device that can create a controlled pattern of particles of toner on a receiver 42 and can include printers, copiers, scanners, and facsimiles, and analog or digital devices, all of which are referred to herein as "toner printers." These can include, but are not limited to, electrostatographic printers such as electrophotographic printers that employ toner developed on an electrophotographic receiver, and ionographic printers and copiers that do not rely upon an electrophotographic recording medium. Electrophotography and ionography are types of electrostatography (printing using electrostatic fields), which is a subset of electrography (printing using electric fields).

An ink image 78 and toner image toner image 138 deposited on receiver 42C, receiver 42C is subjected to heat or pressure to permanently fix toner image 38 to receiver 42C. Plural print images, e.g. of separations of different colors, are overlaid on one receiver before fixing to form a multi-color fused image 39 on receiver 42C.

Toner printer 16 has a fixing system 60 that fuses toner image 38 to receiver 42C. Transport belt 26 transports a toner-image-carrying receiver 42C to fixing system 60, which fixes the toner particles to the respective receivers 42C by the application of heat and pressure. Receiver 42C is then serially de-tacked from transport belt 26 to and fed into fixing system 60. Transport belt 26 is then reconditioned for reuse at cleaning station (not shown) by cleaning and neutralizing the charges on the opposed surfaces of the transport belt 26.

In the embodiment of FIG. 2, fixing system 60 takes the form of a heated fusing roller 62 and an opposing pressure roller 64 that form a fusing nip 66 therebetween. In an embodiment, fixing system 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed. Print 100 includes carrying the fused image (e.g., fused image 93 which is transported from fixing system 60 along a path either to output tray 91, or back to marking engines 131, 132, 70 to create an image on the backside of the receiver of a print 100 i.e. to form a duplex print.

In various embodiments, post printing processing system 18 can provide between additional finishing systems such as those that are known in the art for handling media-handling operations, such as folding, stapling, saddle-stitching, collating, and binding. As discussed above with reference to FIG. 1, control system 20 controls operation of printer 10.

Figure 3:
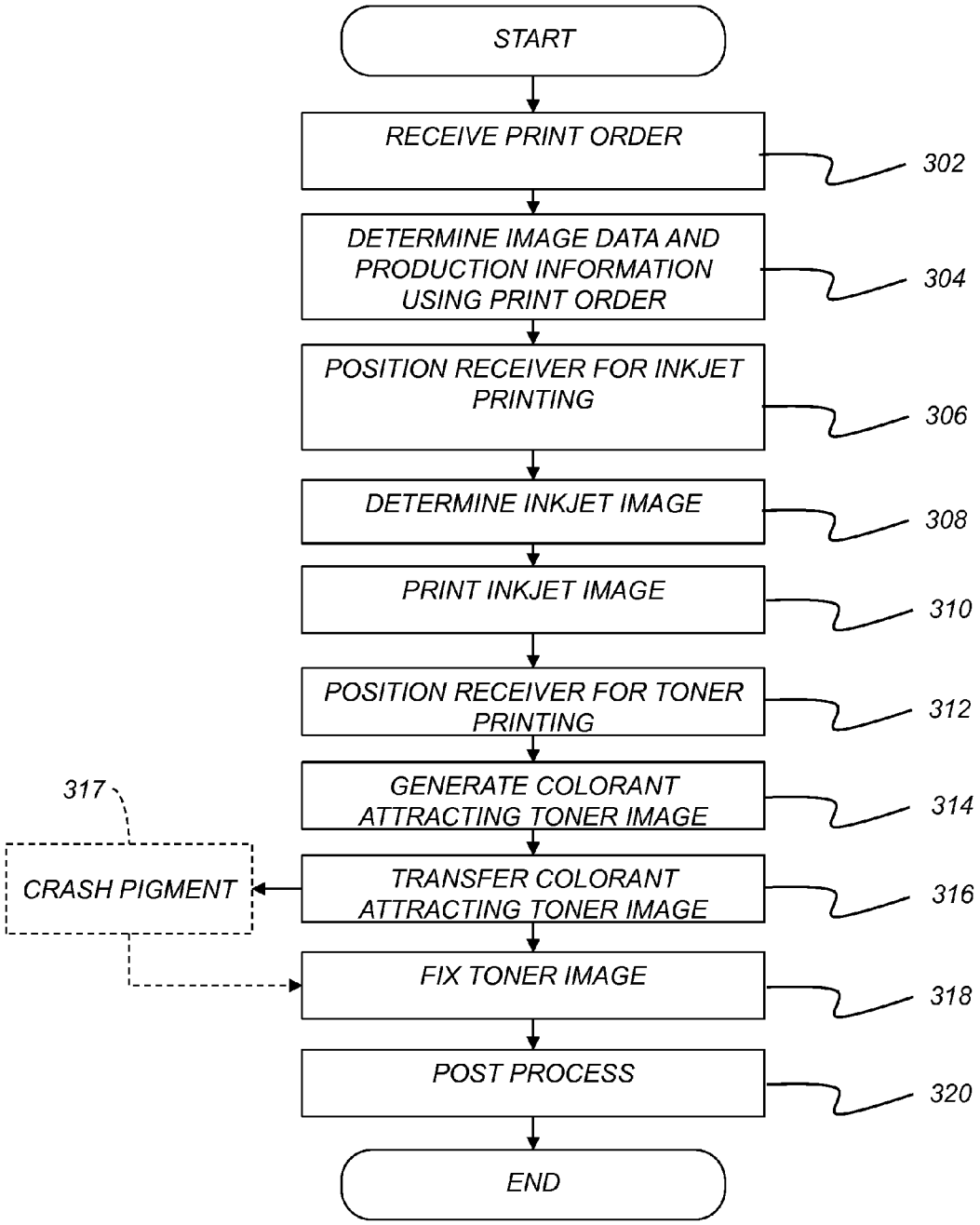
FIG. 3 shows one embodiment of a printing method.

FIG. 3 shows an embodiment of a method for ink jet printing on semi-absorbent and non-absorbent media such as receiver 42 and that can be used for example with the embodiment of printing system 10 shown in FIG. 1. In the embodiment of FIG. 3 printing begins when a print order is received (step 300) and control system 20 uses the print order to obtain image information and production information (step 302). The image information can include any type of information that can be used by control system 20 to obtain, recreate, generate or otherwise determine image information for use in printing and the image information can comprise any type of information that can be used to form any pattern that can be made using inkjet printer 12. The production information can include printing information that can be used to determine what receiver 42 inkjet image 78 is to be printed on. The production information can also optionally indicate how the image information is to be printed and can provide finishing information that defines how the print is to be finished, and can include information for cutting, binding, glossing, sorting, stacking, collating, and otherwise making use of a print that is made according to the image information and printing information.

In one example, the print order includes image information in the form of image data such as an image data file that control system 20 can use for printing and also contains production information that provides printing instructions that control system 20 can use to determine how this image is to be formed and what receiver 42 is to be used in the printing. In another example, the print order can comprise image information in the form of instructions or data that will allow control system 20 and communication system 36 to obtain an image data file from one or more external devices such as separate servers or storage devices (not shown). In another example, a print order can contain image information in the form of data from which printer controller 82 can generate the determined image for example from an algorithm or other mathematical or other formula. In another example, the image information can include image data from separate data files and/or separate locations, and/or other types of image information. These examples are not limiting and a print order can be received and image information and production information can be obtained using the print order in any other known manner.

Control system 20 then causes transport system 24 to position receiver 42 so that an inkjet image 78 can be recorded thereon (step 306), determines inkjet image data for printing (step 308) and optionally printing instructions and provides the determined image data for printing and inkjet printer 12 to cause inkjet image 78 to be printed on receiver 42 using an inkjet ink that includes a hydrophilic carrier fluid, e.g., water or various low carbon alcohols such as methanol, ethanol, isopropanol, propanol, butanol, isobutanol, and ethylene glycol, in which colorant can optionally be suspended or dissolved. Hydrophilic carrier fluids can be polar. For colorants suspended in the carrier fluid, the suspension can have a zeta potential, as measured using known techniques and commercially available equipment, greater than 160 mV of either sign potential. Conversely, a zeta potential of less than 30 mV is unstable and a zeta potential between 30 mV and 160 mV is semistable. A stable ink containing an aqueous carrier fluid or solvent and suspended pigment particles has a zeta potential whose magnitude is greater than 160 mV.

Figure 4A:
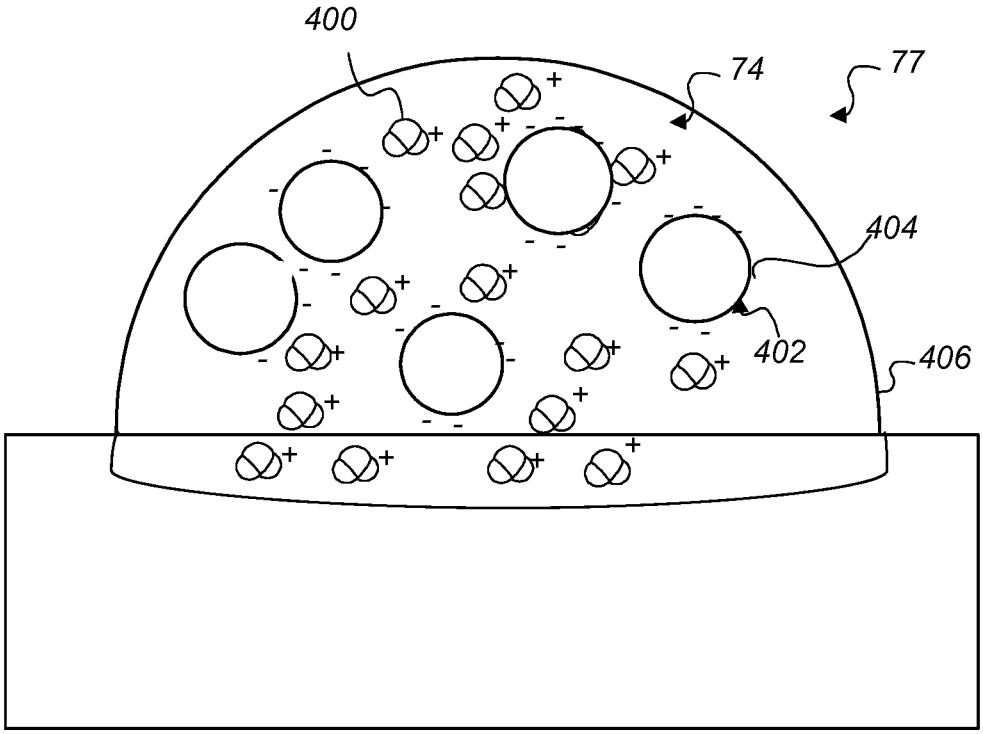
FIGS. 4A-4D show an interaction between ink and toner and a receiver according to various embodiments.

As is shown in FIG. 4A, an ink drop 77 has a carrier fluid in the form of water that has water molecules 400, represented graphically as space-filling models of $H_2O$ molecules. Ink drop 77 also includes colorant particles 402, e.g., pigment particles. Ink drop 77 can also include humectants, surfactants, or salts. These additives help stabilize the ink and reduce the probability of coagulation (agglomeration of suspended pigment particles). Water molecules 400 and colorant particles 402 are oppositely charged in this solution. In this embodiment, these charges arise by way of countercharging in which a colorant particle 402 such as a pigment has a boundary 404 that has a surface charge of the first polarity formed by a counter charge of the second polarity formed by the carrier fluid shown here as water molecules 400 during dispersion. The polarity of colorant particles 402 and water molecules 400 is shown is for the purpose of discussion only and is not limiting.

As is also shown in FIG. 4A, when ink drop 77 come into contact with an absorbent or semi-absorbent receiver 42 some of colorant particles 402 come to rest against receiver 42 as water molecules 400 (or molecules of carrier fluid) are absorbed into receiver 42. However a substantial portion of these colorant particles 402 remain in suspension in a volume 406 of drop 77 on receiver 42 pending drying or absorption of the liquid carrier. The polar charge on colorant particles 402 and the water molecules 400 also remains.

Receiver 42 is then positioned for printing by toner printer 16 before unabsorbed volume 406 of drop 77 remaining on the receiver 42 reaches a point where unabsorbed volume 406 is less than about 50 percent of the volume of drop 77.

Figure 4B:
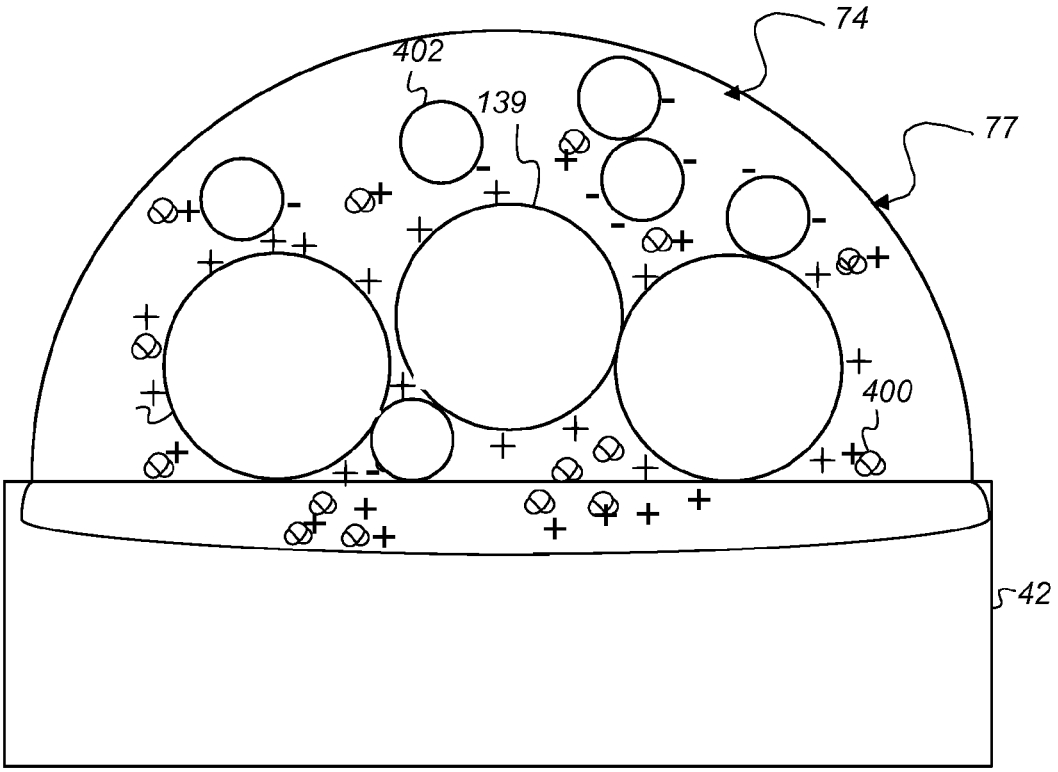
Figure 4C:
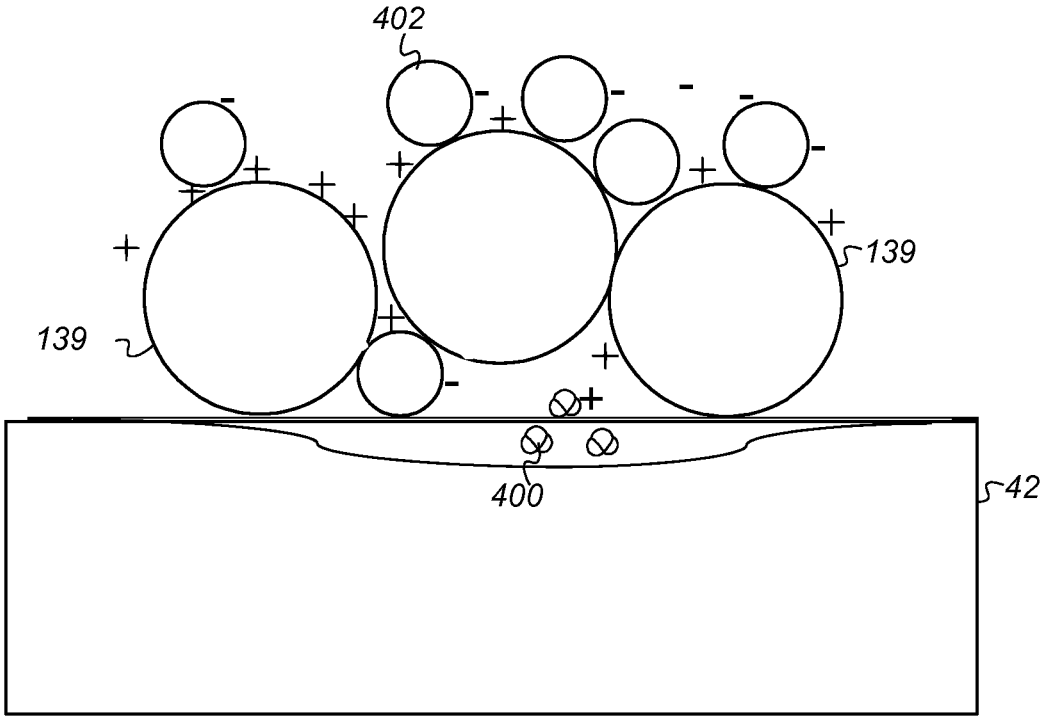

A toner image 138 conforming to inkjet image 78 is generated (step 314) and transferred to receiver 42 (step 316). This introduces toner particles 139 into unabsorbed volume 406 of drop 77. As is discussed in greater detail above, toner particles 139 are electrostatically charged when transferred. Here, the polarity of the charge on toner particles 139 is arranged to be is the same as that of the water molecules 400. As is shown in FIG. 4B, this causes charged toner particles 139 to be electrostatically attractive to colorant particles 402 as the electrical charge on toner particles 139 creates a difference of potential relative to the electrical charge on the colorant 402 attracting colorant 402 to toner particles 139. In one embodiment, during the transfer step control system 20 can automatically operate a power supply 150*a* so that an electrostatic transfer field is created between a transfer roller 152 and a pressure roller 154 to urge colorant attracting toner image to help to transfer the toner particles forming the colorant attracting toner image to transfer into inkjet ink.

In optional step 317, colorant particles 402 suspended in the carrier fluid (water) are caused to come out of suspension in the carrier fluid ("crash") after toner particles 139 have been introduced into the unabsorbed volume 406 of inkjet ink 74 on receiver 42, as an additional mechanism to help colorant particles 402 to be deposited on or within toner particles 139. To do this, the zeta potential should be reduced to below 30 mV.

Zeta potentials can be reduced to below 30 mV by dissolving salts into the suspension (i.e., the pigment-containing ink). Such salts include water-soluble salts of alkali and alkali earth and halogens, nitrates, or nitrites such as sodium chloride, sodium fluoride, magnesium chloride, magnesium fluoride, potassium chloride, potassium nitrate, and sodium nitrate. Particles or thin films of these salts can be incorporated onto the surface of the toner particles deposited in step 310. Alternatively, if the toner has an open cell porous structure, salts can be incorporated within the open cells of the porous toner. Open-cell porous toner has larger surface area available to absorb colorant than do solid or closed-cell porous toners. The pigment is brought out of suspension in the carrier fluid before fixing the toner visible image to the receiver (step 318) so that the toner still has a large surface area to receive the pigment as it crashes. Step 317 is thus followed by step 318.

Figures 5A, 5B, 5C, 5D:
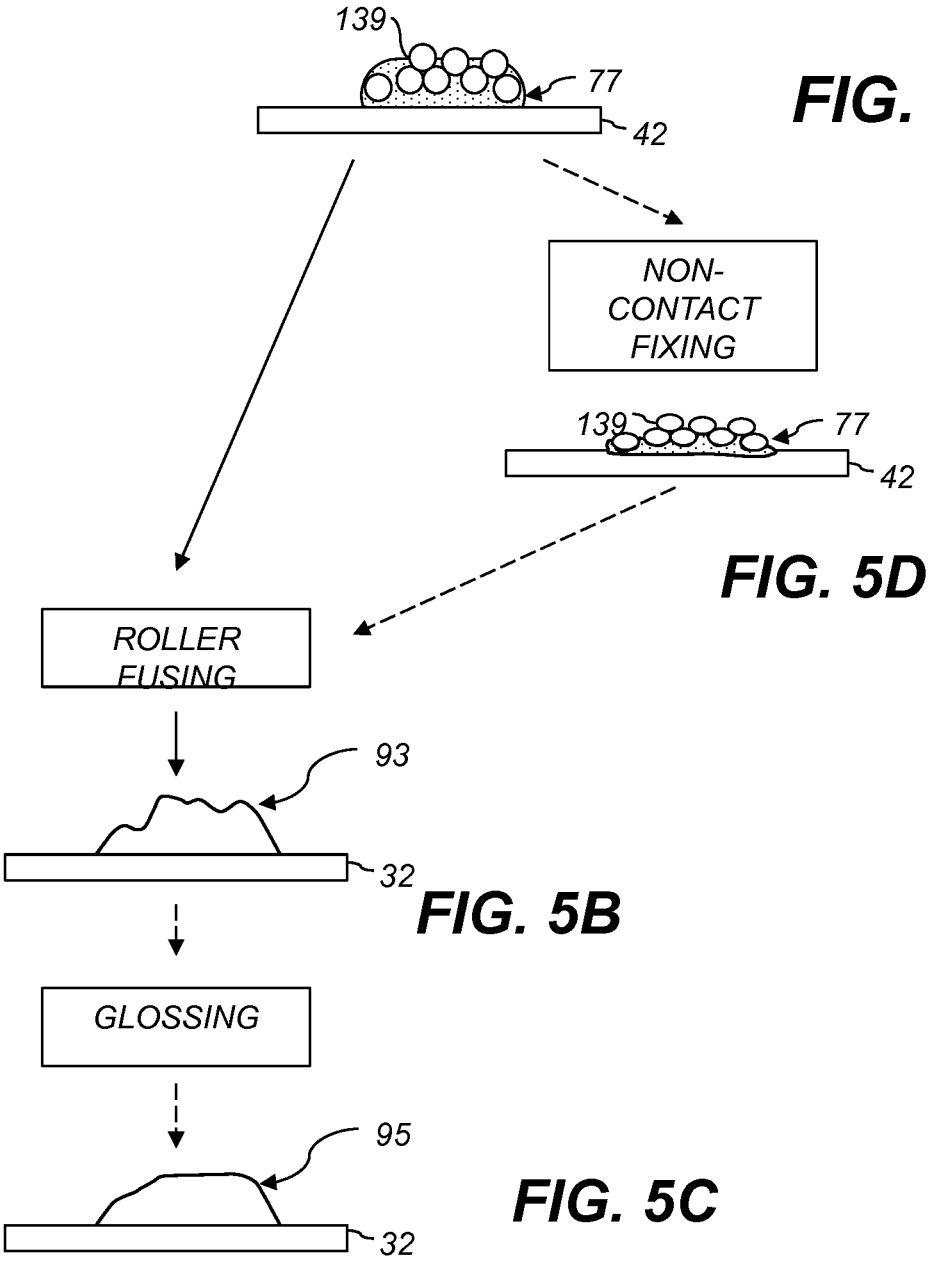
FIGS. 5A-5D show different methods for fixing ink and toner.

Inkjet image 78 and colorant attracting toner image 138 are fused to receiver 42 to create a print 100 having a generally dried inkjet image 78 and a fused toner image 93 thereon (step 320). FIG. 5A shows a liquid management toner image 138 and receiver 42 after transfer of toner image 138. As is shown in FIGS. 5B-D, in various embodiments toner image 138 can be bound to receiver 42 by fixing, including sintering, fusing and glossing operations.

In one embodiment, as is generally suggested in FIG. 5B this can be done using a heated surface such as a belt or a roller that contact toner particles to transfer fixing heat thereto. Such roller or belt type fusing can include or be followed by a glossing operation as is suggested in FIG. 5C which can result in a fused de-inking toner image 93 in as shown in FIG. 5B and a fused and shaped toner image 95 as is shown in FIG. 5C.

Additionally, other approaches can be used to address the problems related to fusing toner image 138 that has unabsorbed volume 406 of a liquid ink jet ink 74 therein. Alternatively non-contact fixing can be used. As used herein, such non-contact fixing generally refers to processes that apply energy to cause toner particles 139 to at least in part be heated to a glass transition temperature without requiring that the heat source to directly contact the toner particles. A variety of known non-contact fusing techniques can be used for this purpose.

Figure 6A:
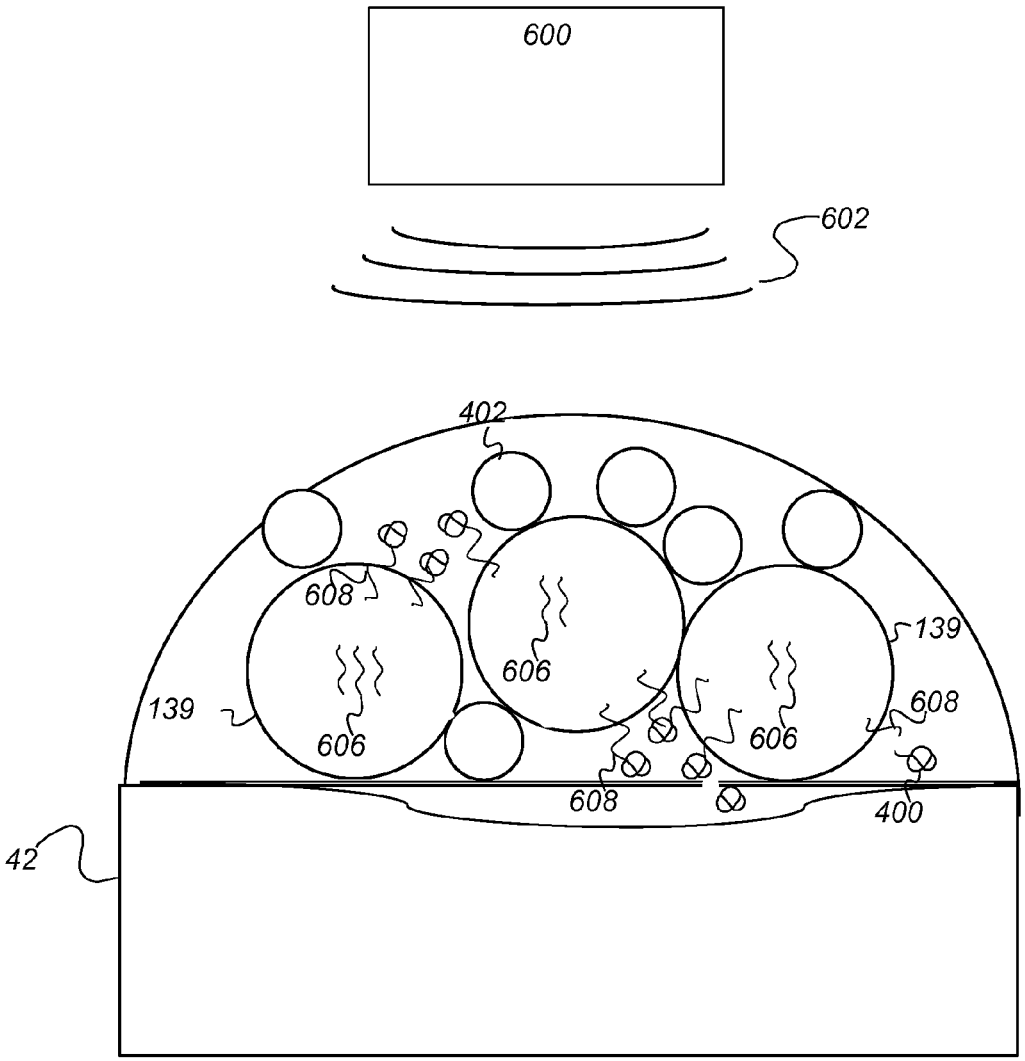
FIGS. 6A-6C illustrate the operation of a method for fixing a liquid infused toner image.

One example of this is illustrated in FIG. 6A, in which a first energy source 600 such any known mechanism for emission of first energy 602 such as microwave or other radio frequency, infrared, or other radiant energies. In other embodiments, first energy source 600 can also be a source of heated air or other gaseous medium supplies a fusing energy to toner particles 139 and water molecules 400 in ink 74. This energy causes toner particles 139 and water molecules 400 to heat.

In this embodiment, water 400 in ink 74 has a boiling point that is above a glass transition temperature for toner particles 139 and the liquid in ink 74 heats more rapidly than toner particles 139 in response to exposure to first energy 602. The liquid in ink 74 thus rapidly heats to temperatures above the glass transition temperature of toner particles 139.

Accordingly, while the temperature of toner particles 139 is raised in part by the application of first energy 602, the amount of fusing energy absorbed and converted into internal heat 606 in toner particles 139 is less than that which is required to heat the toner particles 139 to the glass transition temperature. However, when internal heat 606 is combined with heat 608 from water molecules 400 in ink 74 toner particles 139 heat to a temperature above a glass transition temperature for toner particles 139 so that toner particles 139 will bond to each other and to receiver 42 without requiring heating of receiver 42 to the glass transition temperature of toner particles 139.

Figure 6B:
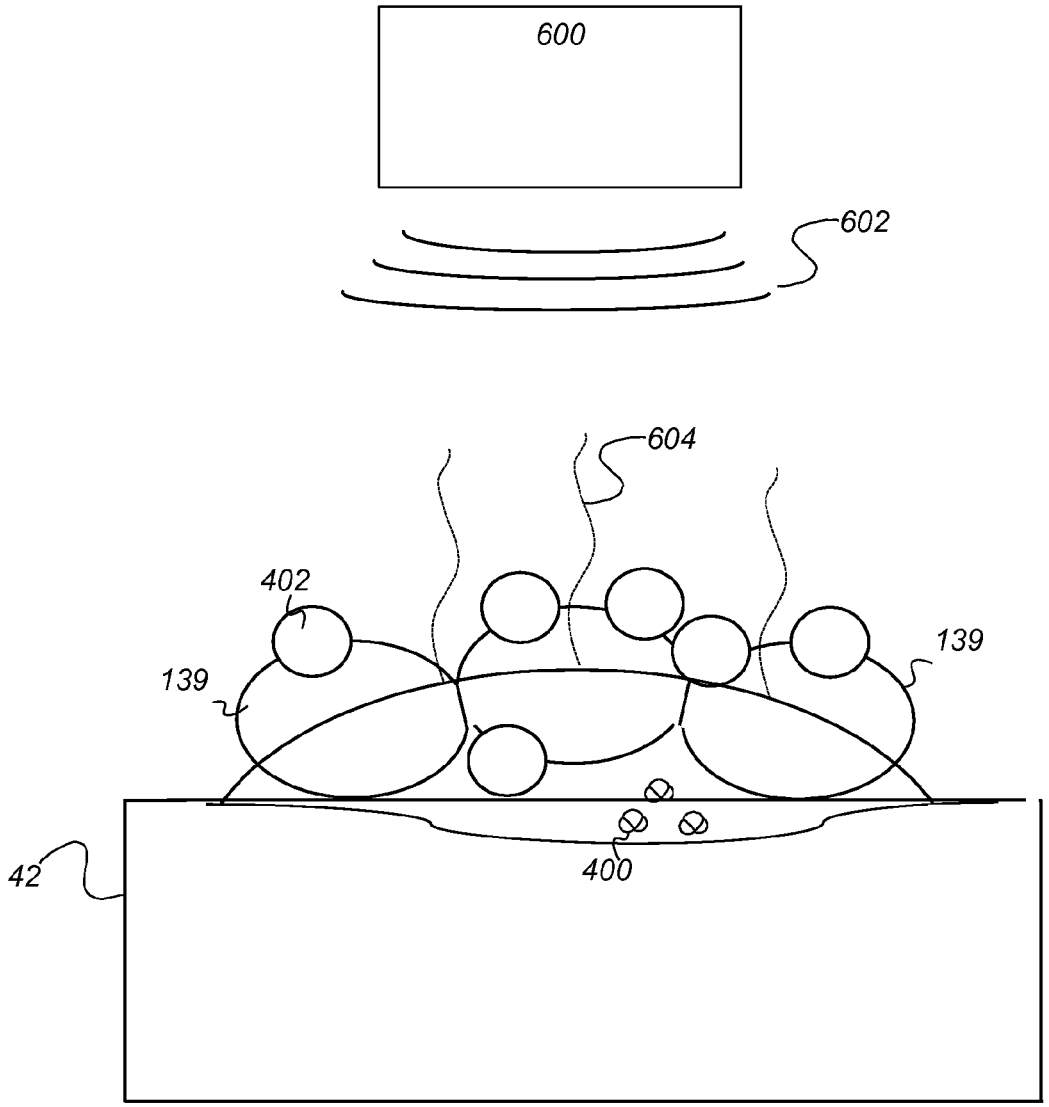

FIG. 6B shows one possible condition of ink 74, toner particles 139 and colorant 402 during exposure to first energy 602. As is shown here, the heat provided by water molecules 400 and by first energy 602 causes toner particles 139 reach a glass transition temperature at which point toner particles 139 begin to press against each other in ways that create cohesive bonds between toner particles 139 and adhesive bonds between toner particles 139 and receiver 42.

Figure 6C:
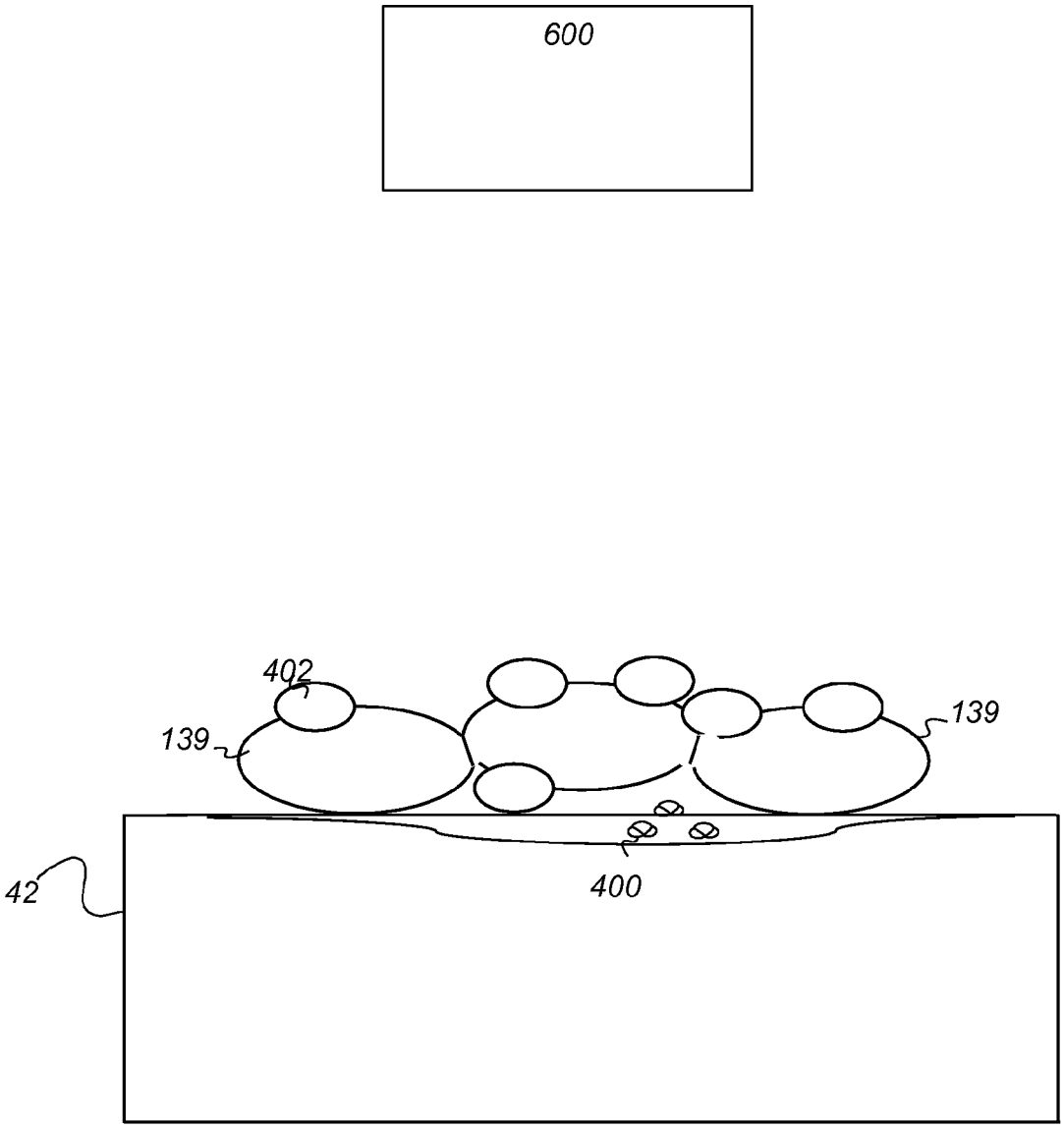

FIG. 6C shows one possible condition of toner particles 139, colorant particles 402 and ink 74 after exposure to first energy 602. As is shown here, depending on the extent of the heat provided and the duration, such non-contact fusing can result in sintering or full fusing of the toner particles. As is also shown in FIG. 6C water molecules 400 may have substantially boiled off during this process, however this is not essential. As is also suggested in FIGS. 6B and 6C, colorant particles 402 may also be changed by the liquid infused non-contact fixing, however this is not necessary.

This liquid enhanced type of non-contact fixing is particularly useful and represents a significant departure from prior art fusing techniques that heat moisture in receiver 42. In one aspect this is because, water 400 or any other liquid on the surface of a receiver 43 does not have to heat through receiver materials to heat toner. Further, water molecules 400 conform to the shape of toner particles 139, and therefore there is a substantial amount of contact area through which they can conduct heat 608 into toner particles 139 in order to cause toner particles 139 to reach the glass transition temperature. These two effects allow non-contact fixing of liquid infused toner images to occur at a much more rapid rate than through the receiver type of non-contact fusing systems. Therefore less fusing energy 602 is required to achieve non-contact fusing of a liquid enhanced toner image 138.

It will be appreciated that the use of this liquid infused non-contact fusing technique provides several other advantages including allowing enabling fixing of a toner image 138 to a receiver 42 while protecting the look and feel of receiver 42 from unintentional modifications that can occur when heated contact surfaces are brought into contact with portions of a receiver 42 that have little or no toner thereon. Further, where such liquid enhanced non-contact fusing is used, spaces between toner particles 139 provide a pathway for vapor to escape from toner image 138 so that pressure does not build within toner image 139. The heating of liquids in ink 74 further helps to enhance the drying process.

Returning to FIGS. 5A-5D, where the process of FIG. 6A-6C does not yield a desired surface smoothness of the toner image 138 non-contact fixing, such non-contact fixing can be followed by a conventional fusing processes such as contact fusing FIG. 513 and or glossing FIG. 5D. Further, such energy can help to or can complete the process of drying the ink jet image.

In one embodiment, control system 20 can use these techniques in different combinations to cause a variety of different effects within a printed image. For example, where a low gloss portion of an image, such as black text is being printed non-contact fusing of a liquid infused toner image can be used, where a higher level of gloss is required, conventional roller fusing can be used, and where a highest level of gloss is to be provided in an image, non-contact fixing can be used in conjunction with contact fusing and glossing. In this regard, it will be appreciated that such liquid infused toner images can be heated in a manner that provides all of the advantages of conventional preheating.

In other embodiments, an optional drying step can be performed before fusing or fixing and can be used to reduce the amount of liquid present in toner image 138 and can warm toner particles 139 to a temperature at or near the glass transition temperature of the toner particles 139 prior to fusing. The heat supplied in such drying can also reduce the possibility that during post processing fusing or sintering the hydrophilic liquid ink that has soaked into the surface of receiver 42 can be brought to a boil. If this happens too quickly for the resulting gas to escape from receiver 42 gradually, the resulting internal pressure in the receiver 42 can puncture part of a thickness of receiver 42 to permit the gas to leave the paper. This can form a blister in receiver 42 that can reduce image quality.

This optional drying step can be performed before fusing, fixing, or sintering and doing so at a lower thermal flux than used for fixing, permits the gas to escape the paper gradually. This reduces the formation of blisters in receiver 42 and also limits the risk that colorant attracting toner image 138 may be modified by vapor pressure.

In one embodiment, the risks of vapor pressure can comprise an additional consideration in determining a colorant attractive toner image, in that the colorant attracting toner image 138 can be defined in a manner that provides avenues 550 for the release of vapor during fusing.

It will be appreciated, that because colorant particles are generally joined to fused toner image 93, and generally do not penetrate into receiver 42, any known process for separating fused toner from receiver 42 can be used to generally de-ink print 100. This permits deinking of print 100 without having to bleach receiver 42 or with substantially reduced inking requirements. This in turn allows a deinkable print 100 to be made according to the methods herein is readily-deinkable and -recyclable and can be made using readily-available hydrophilic inks. Print 100 can be deinked using conventional deinking solvents such as nonpolar organic solvents such as various alkanes and aromatic compounds such as pentane, hexane, octane, heptane, benzene, toluene, xylene, dichloromethane, trichloromethane, tetrachloromethane, 1,1 dichloroethane, 1,2 dichloroethane, 1,1,2 trichloroethane, and 1,1,1 trichloroethane. In various embodiments, deinkable materials are deposited only in the inked areas, and not in the noninked areas. This saves material compared to flood-coating a receiver with an ink-absorbent material. It also permits a viewer of the print to perceive the physical, textural, and visible attributes of the paper, which attributes a flood-coat would mask. Various embodiments permit the printer to produce prints with different perceived characteristics by, e.g., applying texture or gloss, applying an image-specific protective coating, or applying a UV or other fade-preventive overcoat. These effects and characteristics can be applied to the printed region without changing the characteristics of the paper in unprinted areas. In one embodiment, the transfer of the toner particles into the ink jet ink is performed in the presence of an electrostatic field so that the electrical charge on the toner to further urge the colorant to toner particles 139. However, this electrostatic field must be less than an amount that would cause the toner to separate from the receiver 42.

In another embodiment, the toner particles 139 can have an open cell structure. In an open cell porous toner particle 139, voids within toner particle 139 are interconnected and can be connected to the surface of the toner particle 139 to permit surrounding air, liquids or other mediums to enter or pass through the toner particles. The presence of interconnectivity can be determined by either microtoming porous toner particles and examining in a transmission electron microscope (TEM) the cellular structure. Alternatively, BET can be used to determine whether a porous toner has an open or closed cell structure. Specifically, the surface area per unit mass of open cell porous toner particles 139 is greater than that of non-porous toner particles 139 because the porous toner particles 139 are less dense. Thus, the density of a porous toner particles 139 is determined by measuring the volume of a known mass of toner and comparing that to the volume of an equivalent mass of toner of comparable size and polymer binder material. The surface area per unit mass is then measured using BET. For a closed cell porous toner, the surface area per unit mass would be approximately the same as that of the nonporous toner times the ratio of the mass densities of the nonporous and porous toners.

It will be appreciated that open cell toner particles 139 can advantageously provide substantially more surface area than non-porous toner and also require less binder material than conventional toners, such that less thermal energy is required to fuse such open cell toner particles. Further, it will be appreciated that open cell porous toner particles provide liquid inkjet ink 74 from unabsorbed volume 406 a greater number of pathways along which to travel and therefore offer many more pathways for inkjet ink 74 to follow which provide a greater opportunity ensure that colorant particles 402 are positioned within toner particles 139 of a colorant attracting toner image 138 which further enhances the recyclability of a print 100 having such toner particles thereon.

Figure 4D:
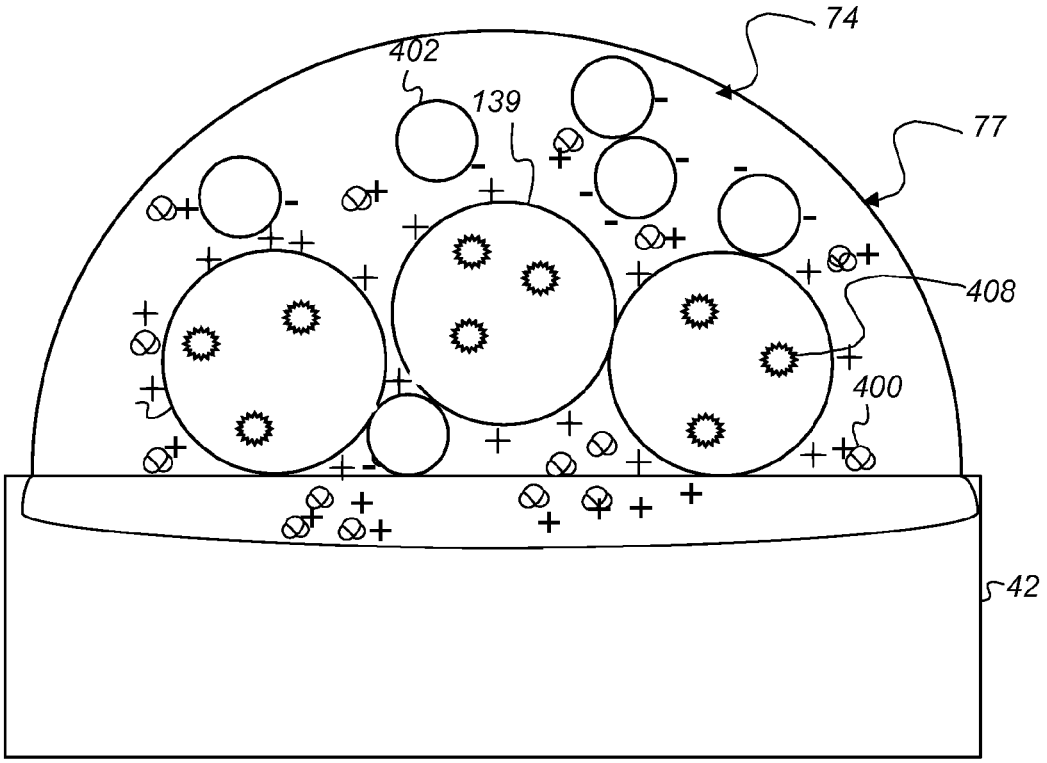

In one embodiment, generally illustrated in FIG. 4D, toner particles 139 include addendum designed to encourage colorant particles 402 to come out of solution or suspension, i.e., to separate more rapidly or completely from water molecules 400. Addendum 408 can be a salt, e.g., NaCl. As is known in the art, such addendum 408 can form a coating such or pattern of particulates on a surface of a toner particle 139 or within open cells of toner particle 139. In one embodiment, open celled toner particles 139 can include addendum 420 inside the open cells, with the addenda being electrically charged with a polarity to attract the colorant into the open cell or having liquid absorbent features.

Figure 7:
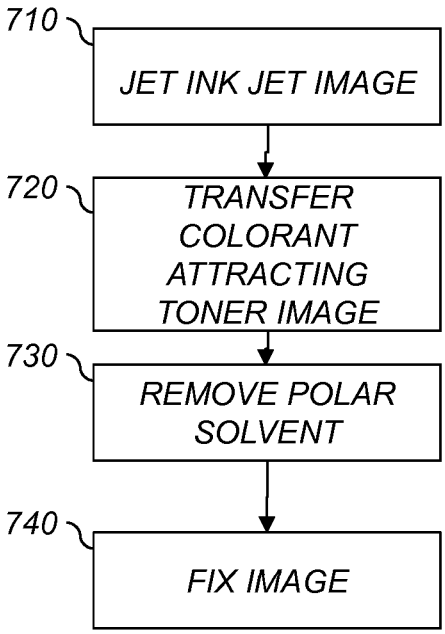
FIG. 7 shows another embodiment of a method for printing an image.

FIG. 7 shows another method of producing a deinkable inkjet print according to various embodiments. In this embodiment, processing begins with step 410.

In step 710, an inkjet image is jetted onto a water-absorbing receiver (e.g., uncoated or porous papers, including bond papers and calendared papers) to produce an ink jet image. The inkjet ink has a carrier fluid comprising a polar solvent such as water or low-carbon-chain alcohols, i.e., alcohols containing four or fewer carbons such as methanol, ethanol, propanol, butanol, and ethylene glycol. Step 720 is followed by step 730.

In step 720, a colorant attracting toner image is transferred are image-wise deposited a colorant-absorbing particulate image. In various embodiments, the colorant-absorbing toner is colorless ("clear") and has an open-cell porous structure. Step 720 is followed by step 730.

In step 730, at least some of the polar solvent is removed from the colorant-absorbing particulate image. This separates the colorant from the hydrophilic liquid and entraps the colorant into a material that is soluble in a hydrophobic organic solvent. This can be accomplished by passing gas through the colorant-absorbing ink image, applying a vacuum to the non-image-bearing side of the receiver, or heating the ink using noncontact heating methods such as those described above. Alternatively, the non-image bearing surface of the receiver can be brought into contact with a hot surface such as a heater to evaporate the solvent. If the solvent is evaporated, the toner should not be permitted to fuse, but can be permitted to tack to create a porous toner mass, as described above. Step 730 is followed by step 740.

In step 740, the colorant-absorbing particulate image is fused to the receiver, e.g., as discussed above with reference to fixing system 160 (FIG. 1).

Toners useful with various embodiments include those with thermoplastic polymer binders such as polyester and polystyrene. The toners should not be thermoset materials, and should not cross-link or change from a thermoplastic to a thermoset, e.g., with exposure to UV radiation, heat, or time. Using non-thermoset toners provides increased solubility of toner in organic solvents commonly used for deinking printed papers. In various embodiments, the polymer binder has a glass transition temperature between 45° C. and 70° C., or between 50° C. and 58° C. In one embodiment, toner particles 139 use a binder which is a thermoplastic that is soluble in a non-polar organic solvent.

In various embodiments, the colorant-attracting toner particles are stained by the colorant (the colorant can be a dye or a pigment). In an example, the colorant is a dye dissolved in the solvent of the ink, and the dye separates from the ink by staining the toner. The toner can be polyester, which can be readily stained by a wide variety of dyes. In various embodiments, the toner does not include polystyrene or polystyrene acrylate, since those materials can be stained by only a limited number of dyes having specific pH levels.

In still another embodiment, a toner image can have toner particles that are made from, are coated with or have addenda thereon that absorbs ink at a faster rate than the receiver. The faster rate can be as much as 10 times greater than that of the receiver 42 creating a flow of liquid drawing the colorants against the toner.

In various embodiments, the polar solvent is removed from the colorant-absorbing particulate image by absorption of the solvent by the receiver, followed by subsequent drying of the receiver. In these embodiments, the receiver can be a receiver that does not contain a clay coating or polymer coating on the surface. The receiver can be dried by conductive, convective, or radiant heating, by pressure, or by combinations of those.

Figure 8:
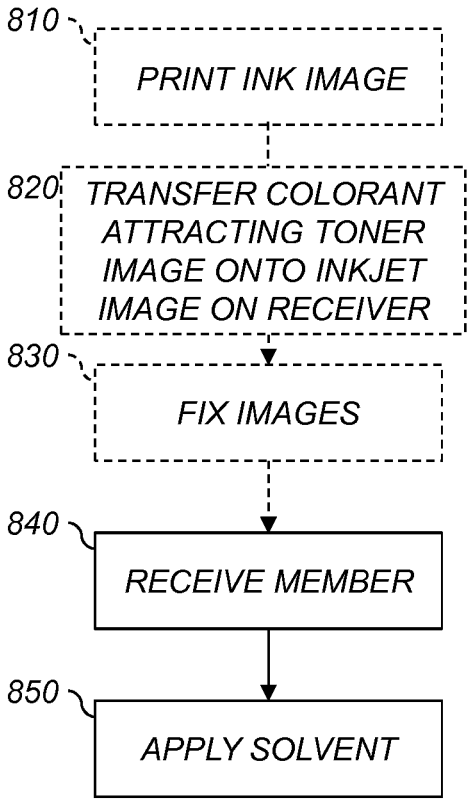
FIG. 8 shows an embodiment of a method of producing a deinkable inkjet print.

FIG. 8 shows a method of deinking a print 100 made using the printing system 10 or printing methods shown in FIGS. 3 and 5 these steps are shown in general and in phantom as steps 810, 820 and 830 in FIG. 6. In this embodiment, deinking begins with step 840. In step 810, the first step of the deinking process, the image-bearing member is received. As has been discussed above, print 100 has thereon fused toner image 93 and with inkjet supplied colorant particles therein. The colorant is insoluble in the organic solvent. Step 840 is followed by step 850.

In step 850, a hydrophobic or oliophilic organic solvent is applied to print 110, so that a majority of the toner image is separated from the image-bearing member. As toner from fused toner image 93 is removed from receiver 42 on which it has been formed, colorant particles are likewise is removed from receiver 42. As a result, a deinked reflection density of the image-bearing member in a selected test area from which the toner image layer was dissolved is within 0.15 of an unprinted reflection density of the image-bearing member before deinking. The unprinted reflection density is the average density of the paper without any colorant thereon.

Figure 9:
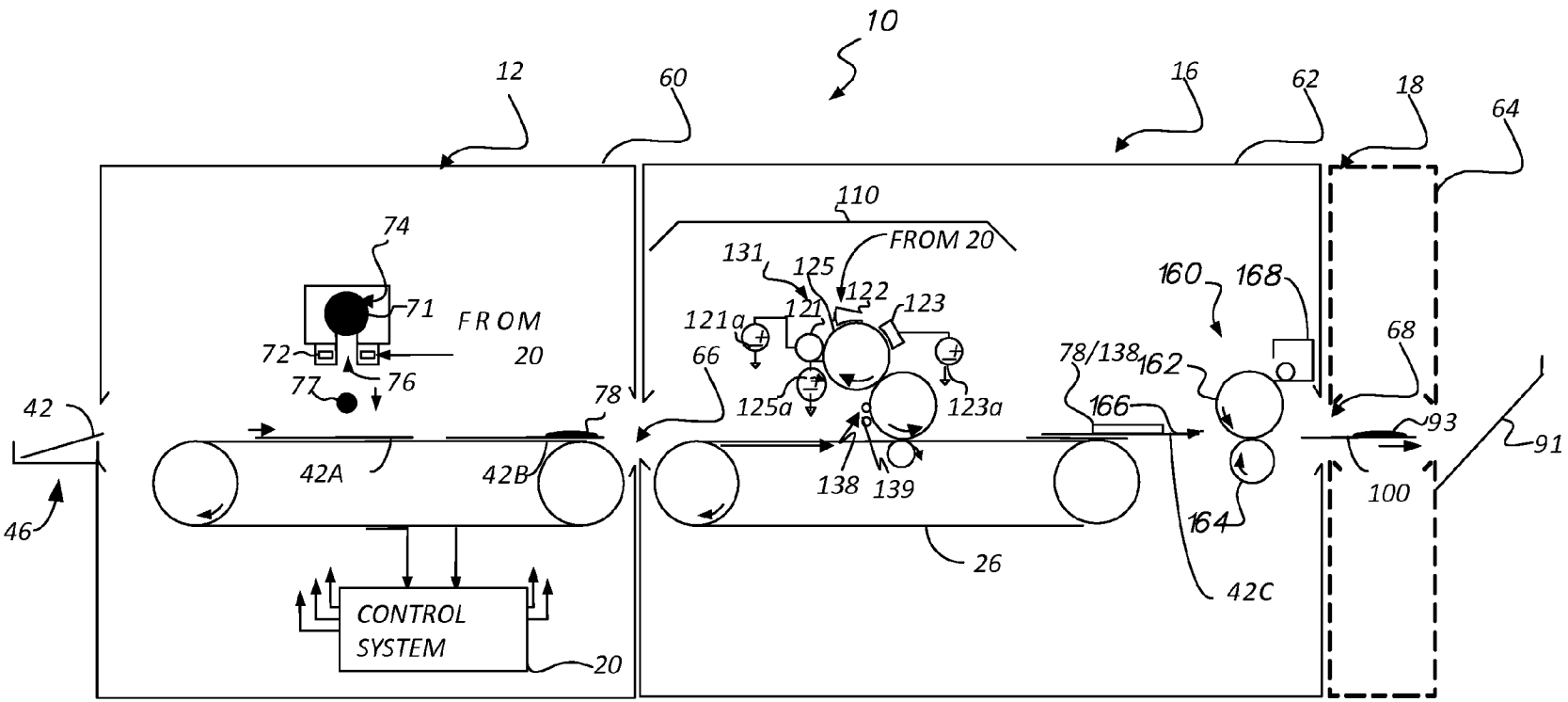
FIG. 9 shows a side schematic view of another embodiment of a printing system.

FIG. 9 shows high level modular embodiment of printing system 10 with toner printer 16 and post printing processing system 18 illustrated as modular attachments to an ink jet printer 12. As is shown in FIG. 7, inkjet printer 12 has a first modular housing 60 that is positioned proximate second modular housing 62 of a toner printer 16. Toner printer 16 is shown proximate an optional third modular housing 64 for an optional post printing processing system 18. The first modular housing 60 and second modular housing 62 are joined at a passage 66, while the second modular housing 62 and third modular housing 64 are joined at a passage 68. Passages 66 and 68 allow receiver 42 to pass between these modular systems. Here, control system 20 is supplied by ink jet printer 12 which provides control signals for use by toner printer 16 and post printing processing system 18. Also, as is shown in this embodiment, and as is true for other embodiments, toner print engine 120 can have one toner printing module shown here as first toner printing module 131 or more one as is shown in FIG. 2.

Various components of printing system 10 have been or described herein as belts or rollers; however as is known in the art, other configurations are possible including but not limited to configurations where rollers perform functions that are shown as being performed by or where belts perform the function illustrated as being performed by rollers. Further, any other known mechanism for controllably conveying a receiver can be used.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

What is claimed is:

1. A printer comprising:

an ink jet printer having an inkjet printhead to print an inkjet image on a receiver using an inkjet ink having a liquid with a boiling point;

a toner print engine to generate a toner image conforming to the ink jet image using toner particles with a glass transition temperature that is below the boiling point and to transfer the toner image into an unabsorbed volume of liquid ink of the inkjet image on the receiver; and a fixing system having a first energy source to apply a first energy to the toner particles and the liquid sufficient to bring the liquid to the boiling point without bringing a heated surface into contact therewith;

wherein the toner particles are heated above the glass transition temperature by the combination of heat from the liquid and heating of the toner particles by the first energy source so the toner particles will cohesively bond to other toner particles and will adhesively bond to the receiver without requiring heating of the receiver to the glass transition temperature of the toner particles.

2. The printer of claim 1, wherein the liquid has a specific heat that is less than a specific heat of the toner particles.

3. The printer of claim 1, wherein an amount of energy required to heat the toner particles to the glass transition temperature with toner particles in the liquid is less than an amount of energy that would be required to heat the toner particles to the glass transition temperature if the toner particles were not transferred into an unabsorbed volume of liquid ink.

4. The printer of claim 1, wherein an amount of first energy required to heat the toner particles to the glass transition temperature is sufficient to bring the liquid to the boiling point.

5. The printer of claim 1, wherein the liquid conforms to a shape of the toner particles so as to provide a greater surface area of contact between the liquid and the toner particles than is provided between the receiver and the toner particles.

6. The printer of claim 1, wherein toner particles in an unabsorbed volume of the liquid can be brought to a glass transition temperature at a faster rate than toner particles that are not in an unabsorbed volume of the liquid using an equivalent exposure to the first energy.

7. The printer of claim 1, wherein the liquid is water or an alcohol.

8. The printer of claim 1 wherein the liquid is hydrophilic.

9. The printer of claim 1, wherein the toner particles are sintered so that vapor pressure from the liquid can pass between toner particles so that the vapor pressure does not accumulate within the toner image.

10. The printer of claim 1, wherein the first energy source comprises a radiant energy source.

11. The printer of claim 1, wherein the first energy source is a source of at least one of infrared radiation, optical radiation, and radio frequency radiation.

12. The printer of claim 1, wherein the first energy source is a source of a flow of a heated gas directed at toner and ink.

* * * * *